United States Patent [19]

Olson et al.

[11] Patent Number: 5,067,736

[45] Date of Patent: Nov. 26, 1991

[54] SLOTTED BRAKE FOR IN-LINE ROLLER SKATE

[75] Inventors: Brennan J. Olson; Thomas J. Brace, both of Minneapolis, Minn.

[73] Assignee: Rollerblade, Inc.

[21] Appl. No.: 396,968

[22] Filed: Aug. 22, 1989

[51] Int. Cl.[5] ..... A63C 17/14

[52] U.S. Cl. ..... 280/11.2; 188/5; 280/11.22; 280/11.27; 403/343; 403/362; 403/408.1

[58] Field of Search ..... 280/11.2, 11.19, 11.27, 280/11.22, 11.23; 188/1.11, 5; 403/343, 362, 381, 408.1

[56] References Cited

U.S. PATENT DOCUMENTS

| | | | |
|---|---|---|---|
| Re. 32,346 | 2/1987 | Klamer et al. | 280/11.2 |
| D. 301,908 | 6/1989 | Olson et al. | D12/226 |
| 805,942 | 11/1905 | Beals | 280/11.2 |
| 864,333 | 8/1907 | Pilz | 301/5.7 |
| 2,220,557 | 11/1940 | User | 280/11.22 |
| 2,343,007 | 2/1944 | Goldenberg | 280/11.2 |
| 2,485,147 | 10/1949 | Fowlkes | 280/11.2 |
| 2,644,692 | 7/1953 | Kahlert | 280/11.22 |
| 2,826,422 | 3/1958 | Snyder | 280/11.2 |
| 2,941,812 | 6/1960 | Reynolds | 280/11.2 |
| 3,112,119 | 11/1963 | Sweet | 280/11.2 |
| 3,112,120 | 11/1963 | Ware | 280/11.2 |
| 3,287,023 | 11/1966 | Ware | 280/11.2 |
| 4,088,335 | 5/1978 | Norton et al. | 280/11.18 |
| 4,108,450 | 8/1978 | Cote | 280/7.13 |
| 4,273,345 | 6/1981 | Ben-Dor | 280/11.2 |
| 4,351,537 | 9/1982 | Seidel | 280/11.12 |
| 4,392,659 | 7/1983 | Yoshimoto | 280/11.23 |
| 4,417,737 | 11/1983 | Suroff | 280/11.115 |
| 4,418,929 | 12/1983 | Gray | 280/11.23 |
| 4,492,385 | 1/1985 | Olson | 280/7.13 |
| 4,689,929 | 9/1987 | Wright | 403/381 |
| 4,711,458 | 12/1987 | Shim | 280/11.22 |
| 4,909,523 | 3/1990 | Olson | 280/11.2 |

FOREIGN PATENT DOCUMENTS

| | | | |
|---|---|---|---|
| 1341539 | 9/1963 | France | 280/11.2 |
| 10262 | of 1909 | United Kingdom | 280/11.2 |
| 1402028 | 8/1975 | United Kingdom . | |

OTHER PUBLICATIONS

North American Sports Training Corporation 1986-1987 catalog, copyright.

Rollerblade "Get In-Line" 1987-1988 catalog, copyright 1987.

Rollerblade 1988-1989 catalog, copyright 1988.

Rollerblade Spring '89 catalog, copyright 1989.

Rollerblade Pink Shirt catalog, copyright 1989.

Rollerblade Seashore catalog, copyright 1989.

Rollerblade "Bladegear" 1989-1990 catalog, copyright 1989.

Rollerblade "Skates+" 1989-1990 catalog, copyright 1989.

Rollerblade "Perfect Gift for Anybody" fold-out brochure, distributed . . . 8/8/89.

*Primary Examiner*—Andres Kashnikow
*Assistant Examiner*—Eric Culbreth
*Attorney, Agent, or Firm*—Moore & Hansen

[57] ABSTRACT

An in-line roller skate and brake utilizes an improved braking assembly in which the brake pad is retained to the brake housing by an interacting tongue and slot system which causes the pad to be tightly forced into the housing during braking. The upper face of the pad is retained to the housing, and compression of the rubber pad forces a slot on the periphery of the pad tightly into locking engagement with the housing so as to provide a substantially improved retention system for the brake pad during heavy braking operation.

5 Claims, 2 Drawing Sheets

SLOTTED BRAKE FOR IN-LINE ROLLER SKATE

BACKGROUND OF THE INVENTION

The invention relates to in-line roller skates and more specifically to an improved brake usable with such skates. In-line roller skates utilize two or more wheels positioned to rotate within a common, vertical plane and while operating as roller skates have much of the feel and behavior associated with ice skates. Substantially the same bodily movements are required to operate both ice and in-line roller skates, and such roller skates have become increasingly popular with skaters as a desirable training tool for off-season and on-street use.

In recent years, in-line skates have been capturing an increasing share of the recreational skate market for skaters of all ages and in time may parallel jogging as a healthy and pleasurable sport. Until recently, the brakes used with in-line roller skates have been rubber, cone-like or cylindrical bodies extending axially from the rear of the skate and which rub against the road surface as the skater pivots his skate rearwardly about the rear-most wheel axle of the skate. Such a system is shown in U.S. Pat. No. 4,909,523 issued Mar. 20, 1990 for "In-Line Roller Skate With Frame", the brake shown in such disclosure having been in public use for more than a year prior to the date of filing this application. While that brake has been one of the most effective on the market, it is desirable to improve the performance still further so as to make braking as effective and reliable as possible.

Improving the brake's performance can be accomplished by enlarging the braking face that engages the road surface on which the skater moves, but applicants have found that the configuration of the brake pad, particularly where it engages the road surface, is subject to severe limitations. These limitations include the need to keep the pad width equal to or less than the width of the rest of the skate's frame in order to avoid the brake snagging on obstacles that might be on the road and near the path of the skater. It is desirable that the skate be configured so that if the frame can pass along a given path, the brake will be able to safely follow. For example, if the skater is moving along a somewhat irregular road surface, the brake should not extend laterally or downwardly from the skate in such a manner that the brake will strike or drag on the road surfaces. These requirements severely limit the configuration possible for a brake pad.

It is important to position the brake pad in close proximity to the road surface, but still maintain sufficient spacing therefrom so that the brake does not engage the riding surface when the skater goes down an incline such as a driveway apron or goes over a road or sidewalk crack or irregularity. Should the brake engage when irregular surfaces are encountered, it can affect the balance of the rider, and is to be avoided.

Applicants have also found that when the brake pad is enlarged so as to obtain a larger contact area with the road surface, the forces applied to the brake pad during operation are substantially increased and that new structural configurations are needed to prevent disengagement of the pad from the brake housing and to assure long, reliable life of the brake. While meeting these requirements, the brake must be very strong, durable, compact, lightweight and aesthetically pleasing to the eye, while still effectively retaining the brake pad even under the most extreme braking condition. The present invention is directed toward a solution of these problems

SUMMARY OF THE INVENTION

The invention comprises a roller skate and brake wherein the brake pad and brake housing utilize a tongue and slot means by which, during braking operation, a tongue on the pad is driven deeply within the slot on the brake housing to inhibit disengagement of the pad from the housing. The brake pad has an upper face which closely engages a rigid plate on the housing, and a screw and nut passes in a generally vertical plane through the pad to clamp the central region of the upper face of the pad to the housing plate, while simultaneously expanding the rubber pad outwardly to force the tongue and slot into tight jamming and interlocking engagement.

A clamping means is provided to closely grip the nut, to position it in coaxial alignment with the screw, and to prevent nut rotation during screw tightening. A longitudinal groove in the plate mateably receives an upwardly extending rib on the brake pad to prevent rotation and twisting of the brake pad about the screw during braking. A pair of downwardly extending, triangular ears are positioned on the lateral side walls of the brake housing and interact with recesses in the pad to securely grip the sides of the brake pad and prevent inadvertent disengagement of the pad from the housing during braking.

These and other objects and advantages of the invention will appear more fully from the following description made in conjunction with the accompanying drawings wherein like reference characters refer to the same or similar parts throughout the several views.

DESCRIPTION OF THE PREFERRED EMBODIMENTS

Figure 1:
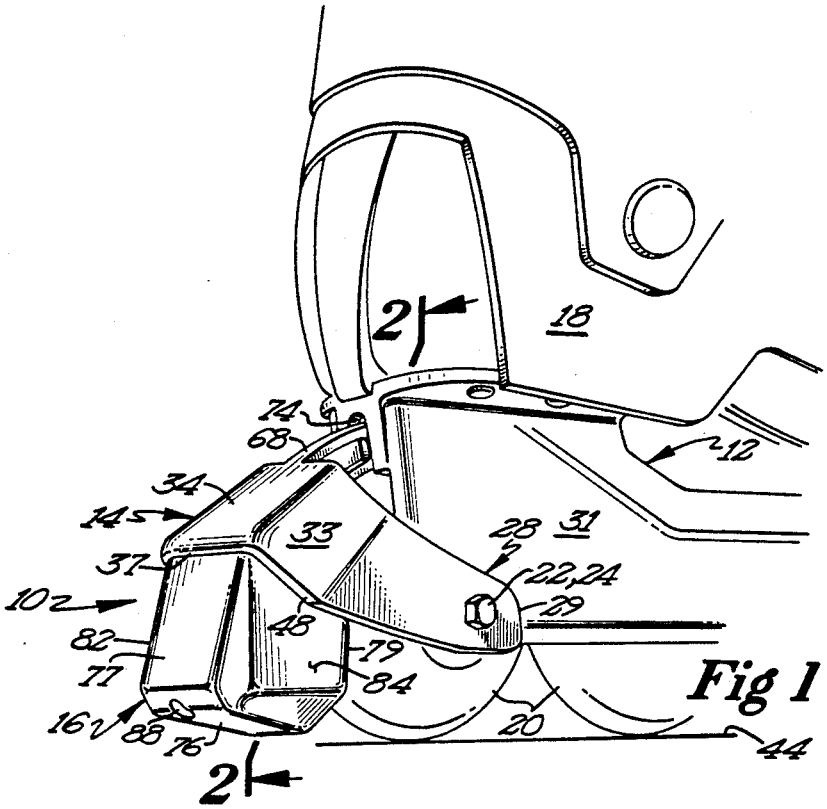
FIG. 1 is a perspective view of a roller skate and brake embodying the invention.

Referring now to FIG. 1 of the drawings, a roller skate and brake 10 includes a roller skate frame 12, a brake housing member 14 and a brake pad member 16, with the skate frame being carried by boot 18 which is worn by the operator.

The roller skate frame 10 is preferably an in-line roller skate utilizing a supporting frame 12 which rotatably carries a plurality of rotating, coplanar wheels 20 which include at least a front and rear wheel, but can include 3, 4 or more wheels for use on a road surface 44. Each of the wheels 20 is carried on a bolt 22 which passes through and is secured to the frame 12 by locking nut 24 and defines a wheel axle of the skate. Each such axle is parallel to the other axles and supports a wheel, with the number of axles being equal to the number of wheels. The skate frame which is preferred for use with the brake disclosed herein is shown and described in U.S. Pat. No. 4,909,523, and in U.S. design Pat. No. 301,908 issued June 27, 1989, the brake and frames shown in such patent and applications being part of the prior art as of the filing of the present application. While a specific skate frame is preferred, it should be understood that other roller skate frames and wheel arrangements may be used with the brake disclosed herein, and are within the purview of the invention.

While a specific boot is shown herein as usable with the skate frame 12, it should be understood that other boots may be substituted and are within the scope of the invention. Although a boot has been found to be the most effective device for attaching the skate frame 12 to the operator, the boot provides but one means for attaching the frame to the operator and other alternative attachment means, including inter alia straps, clamps or the like, which interconnect the skate frame to the user's own footwear, are within the purview of the invention.

Figure 2:
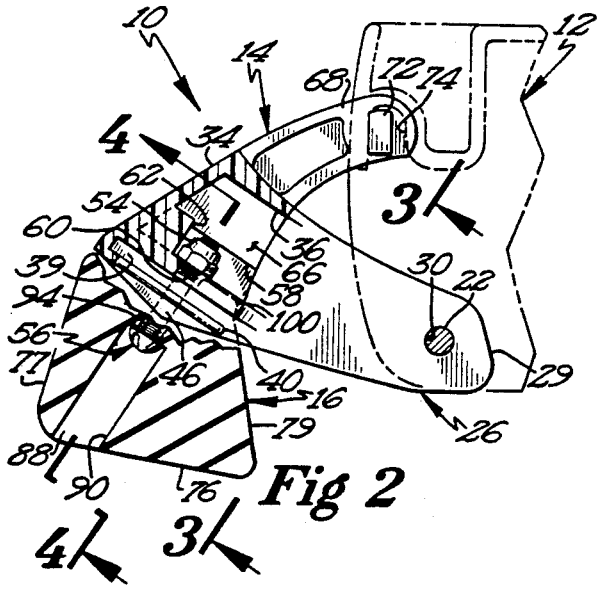
FIG. 2 is a cross-sectional side view through the brake shown in FIG. 1 and taken in the direction of cutting plane 2—2 of FIG. 1.
Figure 3:
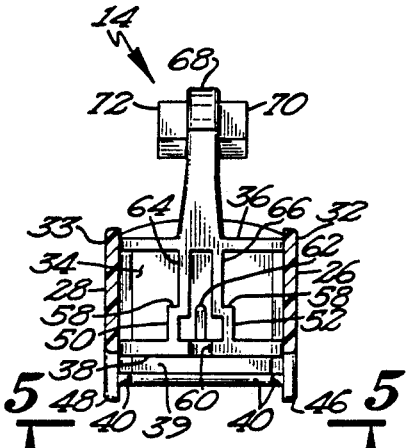
FIG. 3 is a front view of the brake housing member of FIG. 2 taken partially in section, and taken in the direction of cutting plane 3—3 of FIG. 2.
Figure 5:
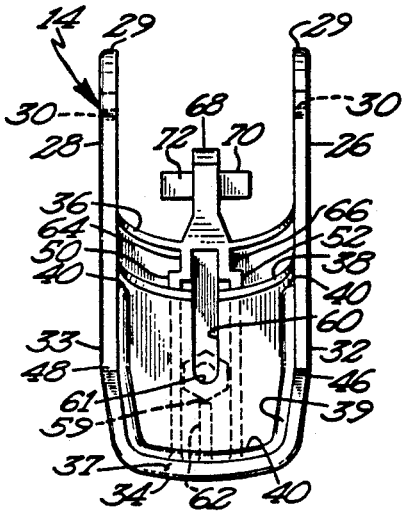
FIG. 5 is a bottom view of the brake housing member taken in the direction of cutting plane 5—5 of FIG. 3.

As best shown in FIGS. 1, 2 and 5, brake housing member 14 has a pair of generally parallel, spaced apart, forwardly extending arms 26 and 28, each of which has a transverse bore 30 adjacent the forward end 29 thereof, which aligns coaxially with the rearmost axle 22, the arms being clamped against the outer side rails 31 of the skate frame 12 by bolt 22 and lock nut 24. The housing member 14 is an integral, molded structure formed of a strong, impact resistant plastic-like material such as glass reinforced, impact modified nylon.

The housing member 14 has a pair of lateral side walls 32 and 33, such side walls being interconnected by rear wall 34. An integral cap 36 extends across the top of the housing member, interconnecting the lateral side walls 32 and 33 and the rear wall 34.

Extending between the walls 32, 34 and 36 and adjacent the lower edge 37 of those walls, is a rigid, flat, thickened plate 38 which overlies the road surface and against which the brake pad member 16, as described hereafter, will bear when mounted for operation. Positioned directly below the plate 38 and extending inwardly from the walls 32, 33 and 34 is a rigid, U-shaped, continuous flange 40 which defines a converging U-shaped slot 39 below and adjacent the plate 38 for receiving and securely retaining a tongue 80 located on the brake pad member and described further hereafter. The flange 40 is substantially parallel to plate 38. Accordingly, the shown tongue and slot provide one type of tongue means and slot means, respectively, which may be used with the invention. While a specific slot and tongue have been shown herein as being preferred, it should be understood that such embodiments are merely illustrative of various tongues and slots which may be used, and other tongue and slot arrangements may be substituted and are within the purview of the invention.

While the invention has been described as having a tongue on the pad member and a slot on the housing member, it should be understood that the tongue can also be placed on the housing member and the slot on the pad member, and such an alternative is within the purview of the invention.

A pair of downwardly extending, generally triangular ears 46 and 48 are positioned directly below the flange 40 and are molded integrally with the side walls 32 and 33 to provide lateral support to and retention of the brake pad 16, as described further hereafter.

Positioned directly above the plate 38 and extending upwardly therefrom are a pair of spaced apart tracks 50 and 52 which confront one another and extend rearwardly to join rear wall 34. These tracks cooperate and define a nut clamping means to engage the parallel, opposed side faces 42 and 43 of lock nut 54 when the brake pad member 16 is attached to the housing member 14 by screw 56. The tracks 50 and 52 include converging, overlying soffits 58 which further confine the nut 54 and retain it such that the nut cannot rotate or escape from the tracks when the screw is advanced through the nut. Located directly below the tracks 50 and 52 is an elongated groove 60 formed in the plate 38 and extending in a generally forward direction to allow sliding insertion or removal of the screw 56 or other alternative fastening means when the brake pad 16 is installed in or removed from the housing. Positioned adjacent the rearmost end 61 of the groove 60 is a generally vertical stop 62 which is positioned to contact the rear corner 59 of the nut 54 and assure that the nut is positioned with its threaded aperture coaxially aligned to receive screw 56 when the brake pad member 16 is installed.

Positioned directly above the soffits 58 of tracks 50 and 52 and extending upwardly to the cap 36 are a pair of vertical webs 64 and 66 which extend rearwardly to the rear wall 34. The webs 64 and 66 and the tracks 50 and 52 collectively define a column which extends between the plate 38 and the underside of the cap 34 to securely reinforce the plate and to prevent flexing of the plate during brake operation.

Positioned above the webs 64 and 66 and extending upwardly from the cap is a rigid post 68 which has a pair of laterally extending trunions 70 and 72, which are lockably fitted within a socket 74 in frame 12, the post, the trunions and the forwardly extending arms 26 and 28, collectively comprising a means for attaching the brake housing member to the skate frame.

The brake pad member 16 is formed of a sturdy, high friction rubber or like material, is an integral molded body, and has a road surface engaging base 76 which confronts the road surface 44. Rubber having a hardness in the 85 to 95 durometer range has been found highly satisfactory.

Positioned at the top of the pad member and angled downwardly therefrom from rear face 77 is an upper face 78 which terminates at front face 79. Positioned along the face 78 and extending laterally and rearwardly therefrom is a tongue 80 constructed and arranged to slide into and be mateably received in the slot 39 of the brake housing member.

Positioned on the lateral faces 82 and 84 of the pad member and directly below the tongue are a pair of generally triangular recesses 85 and 86 for receiving the triangular ears 46 and 48, respectively.

A longitudinal aperture 88 extends from the base 76 to the upper surface 78 of the pad 16 and is generally perpendicular to the surface 78 and plate 38. The aperture contains an enlarged section 90 countersunk to provide a seat 92 against which the enlarged head 94 of screw 56 may bear.

Figure 6:
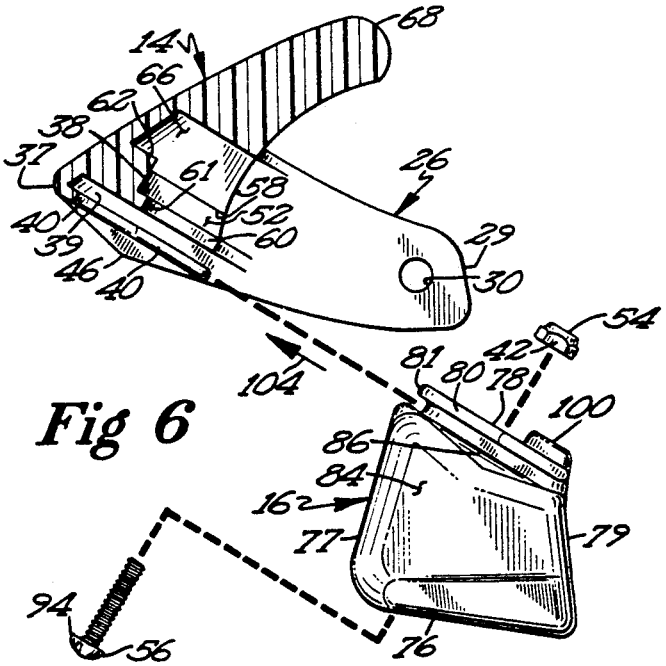
FIG. 6 is an exploded side view of the brake housing member and pad member and taken partly in section.
Figure 7:
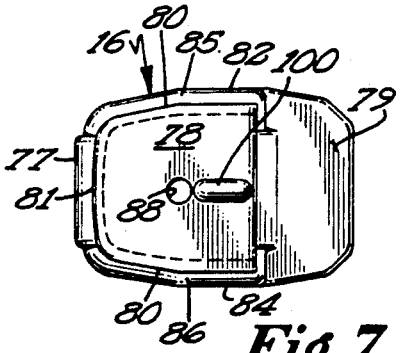
FIG. 7 is a top view of the brake pad member.

Referring now to FIGS. 6 and 7, a rib 100 is formed integrally with the pad 16 and extends upwardly from the forward edge of the upper face 78, the rib being configured to fill the groove 60 in plate 38 when the pad member is fastened to the housing. The interlocking rib and groove 60 cooperate to prevent the pad 16 from twisting about the axis of screw 56.

Figure 8:
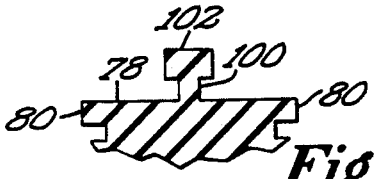
FIG. 8 is a partial front cross sectional view of a brake pad having a cross bar at the top thereof and comprising an alternative embodiment of the brake pad member shown in FIGS. 1–7.

Referring next to FIG. 8, a modification of the pad member is shown wherein the rib 100 has been provided with a transversely extending bar 102 which extends outwardly from the groove 60 and closely overlies plate 38 to resist downward flexing of the pad away from the plate, as well as resisting twisting of the pad about the axis of screw 56. The bar 102 also effectively traps the nut 54 in the tracks and assures that the nut remains aligned with the aperture 88 and that the nut cannot be accidentally lost should it become detached from the screw 56.

In operation of the brake with the roller skate, the nut 54 is slid into tracks 50 and 52 against stop 62 and tongue 80 is slid rearwardly into the slot 39 until the rearmost edge 81 of the tongue is fully, mateably engaged with the rearmost portion of the slot. The nut 54 is effectively prevented from turning by the tracks 50 and 52 and its side faces 42 and 43 closely engage the tracks 50 and 52, respectively, with the edge 59 of the nut 54 bearing against the stop 62, resulting in the central aperture in the nut being aligned coaxially with the central passage 88 in the pad member 16. The assembler next inserts screw 56 into aperture 88 with its large diameter head 94 bearing against the countersunk seat 92 as the screw is tightened to advance it through the nut 54. As the screw and nut tighten, the plate 38 and the upper surface 78 draw tightly together, and the rib 100 is pulled into groove 60.

Figure 4:
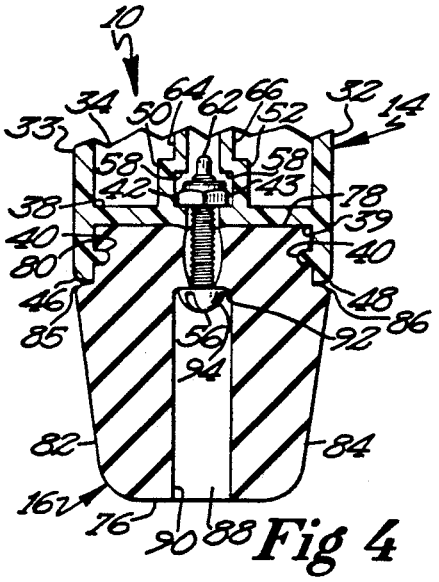
FIG. 4 is a cross-sectional front view of the brake housing member and brake pad member taken in the direction of cutting plane 4—4 of FIG. 2.

As the screw 56 is further tightened, it compresses the rubber material of the pad, urging the material radially outward away from the axis of the screw 56 as best shown in FIG. 4. As this compression of the rubber occurs, the tongue 80 is forced radially outward away from the screw, causing it to wedge against and jam itself tightly within the slot 39 of the housing member 14. This wedging and jamming which occurs as a result of tightening of the screw 56, assures that the pad member is tightly, securely retained in the brake housing, even under severe brake application conditions. The tight engagement between the face of the pad member 16 and the plate 38 prevents the central region of the face 78 immediately adjacent the screw aperture 88 from being pulled downwardly during braking conditions, and thus prevents possible dislodgement of the tongue 80 from the slot 39. The thickening of the plate 38 and its strong reinforcement by the tracks 50 and 52 and webs 64 and 66, inhibit the plate from flexing downwardly during braking conditions and thus assure that there will be no dislodgement of the brake pad from the housing.

Because the tongue 80 is inserted in a rearward direction into the slot 39 of the brake housing member, during braking action and as rearward forces are applied to the brake pad 16 as a result of braking, the tongue is forced toward the slot of the brake housing, thus increasing the locking engagement during braking and further decreasing the likelihood of disengagement of the pad from the housing. The column created by the webs and tracks assures that any forces applied to the plate 38 during braking are applied vertically up to the cap 36 and that a strong vertical column reinforces the plate and prevents destructive flexing of the plate.

Tightening of the screw 56 also causes the side faces 82 and 84 of the brake pad to bulge outwardly where they contact the downwardly extending, triangular ears 46 and 48, thus pushing the triangular apertures 85 and 86 tightly into engagement with the ears to provide an additional locking mechanism which cooperates with the tongue and slot to retain the pad to the housing.

While the preferred embodiments of the present invention have been described, it should be understood that various changes, adaptations and modifications may be made therein without departing from the spirit of the invention and the scope of the appended claims.

What is claimed is:

1. A roller skate and brake usable on a road surface by an operator to achieve improved braking efficiency comprising:

an in-line roller skate frame carrying a plurality of wheels mounted for rotation about a plurality of parallel axles, said axles including at least front and rear axles to permit rolling movement of said frame in forward and rearward directions;

means for attaching said skate frame to the operator;

a brake housing member formed of substantially rigid material and including:

means attaching said housing member to said skate frame;

a pair of lateral side walls and a rear wall extending between said side walls; and a rigid plate extending between said side walls and said rear wall and positioned to overlie the road surface;

an integral brake pad member formed of resilient material having a high coefficient of friction carried by said housing member and including first and second lateral side faces, a front face, a rear face, an upper face and a base, said base confronting the road surface so as to frictionally engage the road surface when said skate frame is pivoted about said rear axle to bring said base into contact with the road surface;

slot means on one of said members and tongue means on the other of said members with said tongue means being mateably received within said slot means to cause said pad member to be retained to said housing member with said upper face of said pad member closely confronting said plate;

said slot and tongue means being constructed and arranged such that during braking operation said members are urged into locking engagement with one another as a result of frictional forces generated between said pad member and the road surface, said forces urging said pad member rearwardly against said housing member to drive said tongue means into said slot means so as to increase the locking engagement between said members during braking;

said pad member including a generally upright aperture extending between said upper face and said base;

said housing member including an aperture in said plate positioned to communicate with said pad member aperture when said tongue means and slot means are mateably engaged;

fastening means extending through said communicating apertures to retain said tongue means in said slot means;

said fastening means being a screw and a nut, said screw including a shaft for receiving said nut; and wherein said plate aperture is an open ended, forwardly extending groove for slidably receiving and guiding said screw shaft when said screw shaft extends from said pad member aperture and while said tongue means slides into mating engagement with said slot means.

2. The roller skate and brake of claim 1 wherein said brake housing member includes nut clamping means positioned adjacent said plate and along said groove to prevent rotation of said nut when said screw shaft is rotatably advanced into said nut during tightening of said screw.

3. The roller skate and brake of claim 2 wherein said brake housing member includes a stop adjacent said nut clamping means to engage and center said nut over said aperture in said mateably engaged pad member.

4. The roller skate and brake of claim 2 wherein said brake housing member further includes a cap above said plate and further includes at least one web means parallel to said screw shaft and engaging and extending between said nut clamping means and said cap to inhibit vertical flexing of said plate during braking operation.

5. The roller skate and brake of claim 1 wherein said pad member includes a rib mateably engaging said groove of said brake housing member to inhibit twisting of said pad member relative to said housing member.

* * * * *